US005673863A

United States Patent [19]

Pallmann

[11] Patent Number: 5,673,863

[45] Date of Patent: Oct. 7, 1997

[54] SIZE REDUCTION APPARATUS FOR THE PRODUCTION OF PRISMATICAL AND PARTICULARLY CUBICAL PARTICLES FROM CUTTABLE MATERIALS

[75] Inventor: Hartmut Pallmann, Zweibruecken, Germany

[73] Assignee: Pallmann Maschinenfabrik GmbH & Co., KG, Zweibruecken, Germany

[21] Appl. No.: 515,868

[22] Filed: Aug. 16, 1995

[30] Foreign Application Priority Data

Aug. 17, 1994 [DE] Germany ..... 44 29 181.7
Aug. 11, 1995 [DE] Germany ..... 195 29 613.3

[51] Int. Cl.[6] ..... B02C 18/14; B02C 18/18

[52] U.S. Cl. ..... 241/85; 241/88; 241/229

[58] Field of Search ..... 241/85, 86.1, 88.1, 241/88, 229

[56] References Cited

U.S. PATENT DOCUMENTS

| | | | |
|---|---|---|---|
| 2,874,909 | 2/1959 | Pallmann | 241/85 X |
| 4,235,382 | 11/1980 | Smith | 241/28 |
| 4,638,697 | 1/1987 | Hager et al. | 83/353.6 |
| 4,796,818 | 1/1989 | Thoma | 241/85 |
| 4,858,834 | 8/1989 | Lanham | 241/85 |
| 4,972,888 | 11/1990 | Dean | 241/85 X |

FOREIGN PATENT DOCUMENTS

| | | |
|---|---|---|
| 0 194 341 | 9/1986 | European Pat. Off. . |
| 0 363 220 | 4/1990 | European Pat. Off. . |
| 1 164 039 | 2/1964 | Germany . |
| 1 197 667 | 6/1964 | Germany . |
| 2 719 891 | 11/1978 | Germany . |
| 3 123 392 | 6/1982 | Germany . |

OTHER PUBLICATIONS

Brochure of the Uschell company in Valparaison, State of India, p. 64 (No Date Given).

*Primary Examiner*—John M. Husar
*Attorney, Agent, or Firm*—Foley & Lardner

[57] ABSTRACT

An apparatus for cutting cuttable pieces, especially of animal or vegetal origin, into prismatic, preferably cubical shape, includes two concentric knife rotors, inner and outer knife rotors. The inner knife rotor carries a first cutting tool for cutting the cuttable pieces into slices and strips. The first cutting tool includes a plurality of plate-shaped knives and a plurality of sets of gate forming knives positioned in passage channels formed in the inner knife rotor. Each set of gate forming knives is positioned adjacent to and upstream of one of the plate-shaped knives. The gate forming knives first simultaneously cut the cuttable pieces into a plurality of strip sections. The associated plate-shaped knife then slices the strip sections to form individual strips, which are led out of the passage channel. The outer knife rotor carries a second tool, a plurality of plate-shaped knives, that cross cuts the strips coming out of the passage channels according to the desired length. Guides, which press the cuttable pieces against the first cutting tool, are arranged in the interior of the inner knife rotor. The guides can have either a spiral-shaped guideway fastened onto a housing door or rotating guiding vanes.

11 Claims, 5 Drawing Sheets

1
2
3
II
II 1
2
3
5
6
7
8
9
10
11
12
13
17
18
22
23
III
III 5
6
14
15
16
17
17'
18
19
20
21

23
b
l

4
$n_2$
$n_1$
$n_3$
17'
17
19
14
7
22
18
16
15
20
6
5
IV $n_2$
4
$n_1$
18
6
16
b b b b
20

SIZE REDUCTION APPARATUS FOR THE PRODUCTION OF PRISMATICAL AND PARTICULARLY CUBICAL PARTICLES FROM CUTTABLE MATERIALS

FIELD OF THE INVENTION

The invention relates to an apparatus for the size reduction of cuttable materials, especially of animal or vegetal origin, to produce particles having a homogenous prismatic, preferably cubical shape.

BACKGROUND OF THE INVENTION

Such size reduction machines are used for example in the foodstuff industry for the production of meat cubes for instant meals like goulash as well as for the production of food for animals such as dogs and cats. These machines may also be used for the processing of vegetable products as for the extraction of sugar from sugar beets. As a large surface of the particles compared to their mass is advantageous for the extraction process, particles having a long, prismatic form are preferred.

The German patent DE 27 19 891 C1 discloses already a so-called "dicer" for frozen meat that uses a rotatable drum on which knives are arranged, which axial and radial dimensions define the dimensions of the cross sections b and l of the produced cubes. The third dimension d of the cube is however, predetermined by the thickness of the fed material slices of calibrated size.

Another "dicer" for frozen meat is known from the European Patent EP 0 194 341 B1. The apparatus described therein uses a rotatable knife drum carrying alternatively scoring knives and main knives, the scoring knives incising the continuously fed material slices in parallel stripes from which the main knives then peel off cubic particles. Even there the third dimension d is defined by the thickness of the fed material slices.

A similar "dicer" is disclosed in the European Patent EP 0363 220 B1. The system uses a knife drum consisting of equally spaced, circular knife discs arranged at the end of a horizontal conveying belt and working together with the feed drum forming with it an infeed gap and working also together with the preceding advance drum. The first knife drum cuts the fed material into slices of equal thickness d and into strips of same width which are then cross-cut into long cubic particles by a second knife drum with knives extending parallel to the axis in collaboration with a stationary shearing edge.

So, the three known dicers have in common, in that the cutting tools only define both edge lengths b and l of the produced cubic particles whereas the third edge length d is predetermined by the uniform thickness of the fed material slices. These known dicers need an additional calibrating device which cuts the provided material pieces in a first dimensional cut into slices of the same thickness d.

However, a brochure of the URSCHEL company in Valparaison, State of Indiana, U.S.A., on page 64 describes a dicer of the type SL-A that processes the product, as e.g., meat, which is fed as pieces that can be handled by a machine, into uniform cubes in one step of successive three-dimensional cuts. This machine consists mainly of a driving drum arranged horizontally in a cutting chamber and provided with driving paddles in its interior. The driving paddles accelerate the fed material pieces to their rotational speed so that, due to the centrifugal force, the pieces are pressed against the circular inner wall of the stationary cutting chamber and thereby fed at the outlet opening to a circular knife disc arranged transversally thereto. This knife disc separates slices of equal thickness d from the material pieces. Then these material slices of equal thickness get into the active zone of a knife drum consisting of equally spaced knife discs cutting the slices into strips of equal width b in combined action with two draw-in rollers. A further knife drum equipped with cross-cut knives then cuts the material strips into cubic particles of which the length l corresponds to the slice thickness d and the strip width b. This known dicer certainly provides a quite uniform cubical product, but the considerable constructional means required due to the six rotors are disproportionate compared to the low throughput capacity of the machine.

It is accordingly an object of the present invention to provide a size reduction apparatus for the production of prismatic particles from material pieces prepared for the processing in a machine that combines a simple, compact construction with an increased throughput capacity and a high, constant product quality. It is a further object of the present invention to provide an apparatus with multiple technological possibilities of use. Although it was initially designed for the processing of frozen meat blocks and proved to be most suitable for that purpose, it should also be usable for the processing of crops as e.g., sugar beet or potatoes, but also for industrial products such as caoutchouc, rubber or plastics.

SUMMARY OF THE INVENTION

Based on the State of the Art described previously, the object is obtained by the measures of the proposed design, in which two knife rotors are arranged concentrically and wherein the inner knife rotor is multiply equipped with several cutting tools for the cutting of the strips and slices and the outer rotor with the cutting tools for the cross-cutting, a simple and compact size-reduction machine is provided, which allows a considerable increase of the throughput capacity. Thereby guiding tools arranged in the interior of the inner knife rotor bring the material pieces in cutting position at the cutting tools of the inner knife rotor with the pressure required for the bi-dimensional cut sequence.

Cutting devices for crops using a ring-shaped knife rotor with knives showing towards the interior to peel off the slices are already known from the German patent DE 11 64 039, from German document laid open to public inspection DE 11 97 667 and from the German patent application DE 31 23 392. Yet the fundamental difference compared to the present invention is that the cutting tools for the cutting of the strips are arranged in a separate stator outside the knife rotor. So the force pressing the material pieces against these cutting tools particularly necessary for the cutting of the strips is missing. That is why these known cutting devices can be used, if need be, for products having a low consistence, which require low cutting forces most of the time in the case for crops. They cannot be used for products having a high consistence e.g., frozen meat.

A further advantages feature of the invention, therefore, is, the gate-shaped cutting tools for the cutting of the strips arranged in front of the passage channels are arranged just in front of the cutting tools for the peeling off of the slices seen in the direction of rotation of the knife rotor. Consequently the strip-shaped incisions in the material pieces are done before the peeling off cuts of the slices so that the force acting on the material pieces and pressing radially against the inner knife rotor can be fully efficient for the cut of the strips implying a considerable material displacement. This is a distinguishing feature of the invention because all devices described in the prior art have the material pieces first cut into slices of same thickness d and only then divided into strips of same width b.

A further advantageous feature of the invention is that the cutting gate for the strips, consisting of scoring blades arranged at equal axial distances b and parallel to each other, have their cutting edges rising at a flat apical angle opposed to the rotation direction. This flat rising of the cutting edge of the scoring blades effects a drawing cut, which, in conjunction with the force pressing radially on the material pieces, produces perfectly separated strips of the width b. These strips are then separated from the material pieces by the slice or peeling cut of the slice thickness d occuring only thereafter.

A further advantageous embodiment of the invention is that the inner wall of the inner knife rotor is subdivided into several peripheral sections arranged between the cutting tools. These sections rise against the direction of rotation like a spiral to the outside up to the cutting tools according to the slice thickness d to be peeled off. This design guarantees a peeling of the strips in equal thicknesses d, which also requires considerable forces pressing radially onto the material pieces to let them slide close along the spiral shaped wall sections of the knife rotor.

For the generation of these forces of pressure, required for the bi-dimensional cuts for pressing steadily the material parts radially against the inner knife rotor, the invention proposes two alternative solutions. One of them is a stationary guiding system consisting of a guideway preferably curved like a spiral so that it forms with the inner wall of the knife rotor a guiding channel steadily narrowing in the direction of rotation. As a consequence of this steadily narrowing of the guiding channel the knife rotor generates itself the forces of pressures required for the bidimensional cuts of the strips and slices by its cutting forces acting as motive forces, whereby it provides so to say "autogenously" the forces of pressure suitable for the consistence of the material pieces to be processed.

The stationary guideway is fastened at the inside of the housing door in such a manner that it is exchangeable. For, as it will be further explained in the following, specific material characteristics are determinant for the curvature gradient of the spiral-shaped guideway, the guideway can be replaced rapidly by another one having a more suitable form of the spiral when another material having other characteristics must be processed.

The other alternative proposed by the invention for the generation of the required force of pressure is a mobile guiding system, which consists of guiding vanes mounted on a driving rotor arranged concentrically within the inner knife rotor. As a consequence thereof the forces of pressure required for the bidimensional cut sequence are essentially generated by the centrifugal effect.

The cutting tools for the cross-cuts arranged on the outer knife rotor comprise plate-shaped knives. Their quantity, in conjunction with the selectable rotor speeds n1 and n2, define the cut-off frequency and consequently the third dimension l of the produced prismatic particles.

Finally, another advantageous characteristic of the present invention is the constructional combination of the cutting tools for the bidimensional cuts in a knife cassette, which can be inserted into the inner knife rotor. This design allows a rapid exchange of the knife set, which may be necessary due to wear but also when other prismatic dimensions for the particles are required due to change of the production parameters.

BRIEF DESCRIPTION OF THE DRAWINGS

Further details of the invention are illustrated in the following description of a possible embodiment referring particularly to the processing of frozen meat pieces into prismatic particles. The accompanying drawings show in.

DESCRIPTION OF THE PREFERRED EMBODIMENTS

Figure 5:
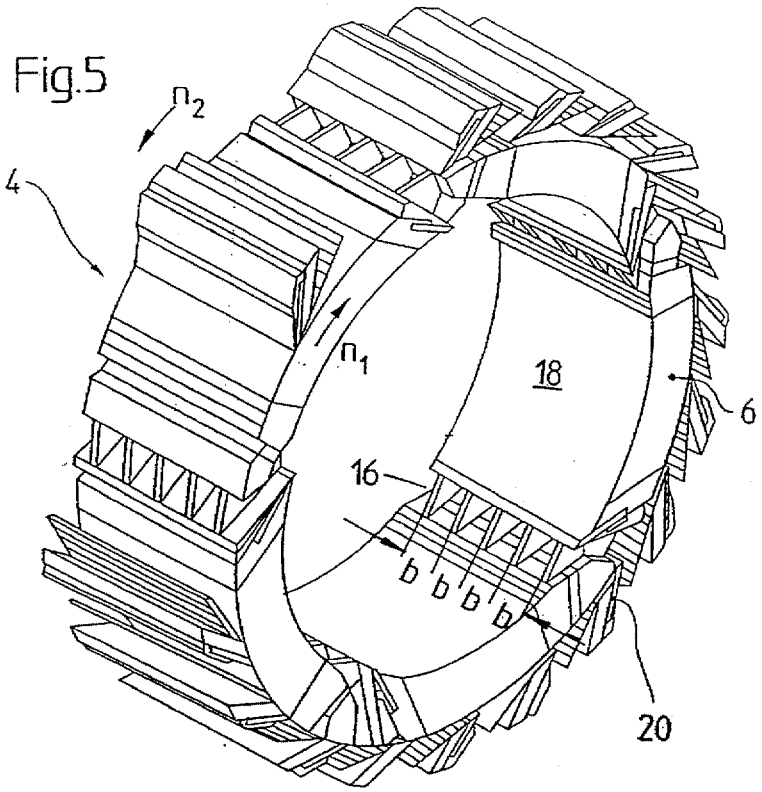
FIG. 5 a perspective view of the rotational cutting system according to the invention without a guiding system.

A machine housing 1 having a frontal swivellable door 2 intergrates therein a feeding chute 3 for frozen meat pieces 22 and has a complete rotational cutting system 4 (see FIG. 5). This rotational cutting system comprises an outer rotor 5 that surrounds a concentrically arranged inner knife rotor 6. The inner knife rotor rotates at speed $n_1$ and in a direction opposed to the rotating direction of the outer knife rotor 5 rotating at speed $n_2$.

Figure 1:
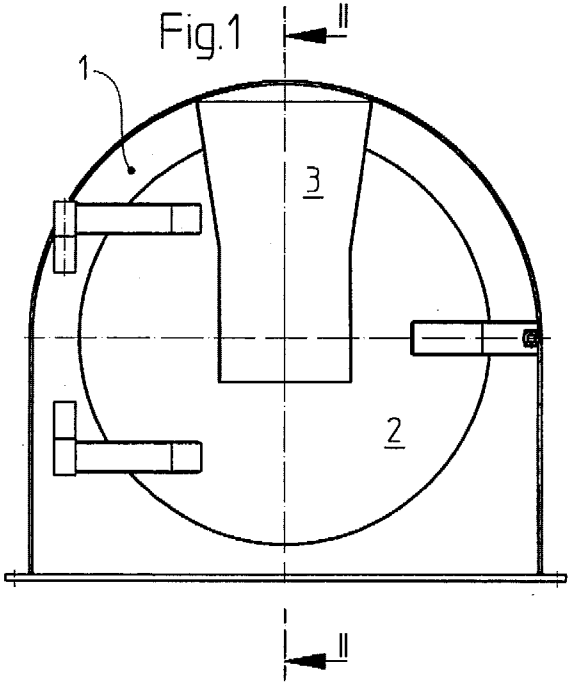
FIG. 1 a front view of the machine according to the invention with a mobile guiding system.
Figure 2:
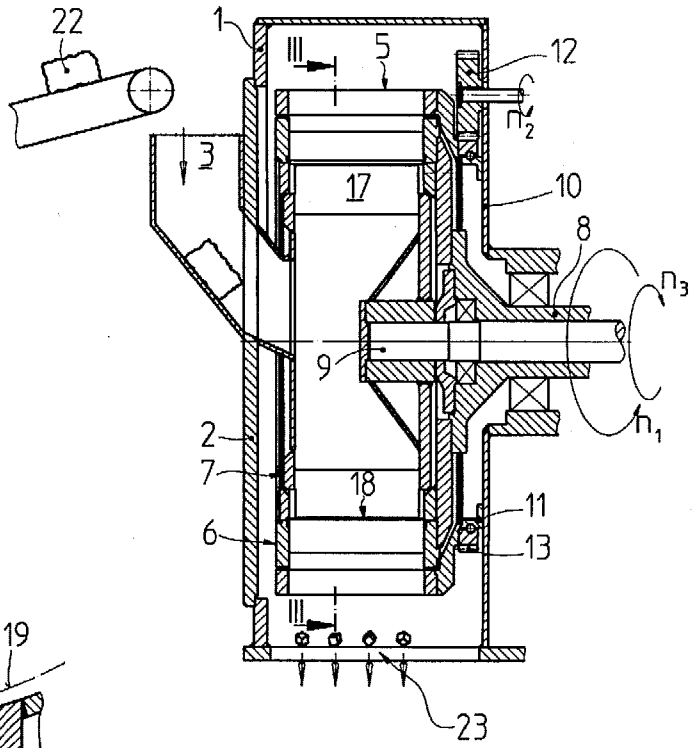
FIG. 2 a cross-sectional view taken along line II—II of FIG. 1 on a slightly larger scale.

As shown in FIG. 2 the inner knife rotor 6 is rotataby journaled about the rear wall 10 of the housing 1 by means of a hollow shaft 8 to which the drive shaft 9 for the driving rotor 7 of the mobile guiding system rotating at speed $n_3$ is rotatably journaled.

The outer knife rotor 5 is rotatably journaled in a ring bearing 11 fastened onto the rear housing wall 10. The driving rotor 7 is driven by a pinion 12 engaging into a gear ring 13 connected to the outer knife rotor 5.

Figure 4:
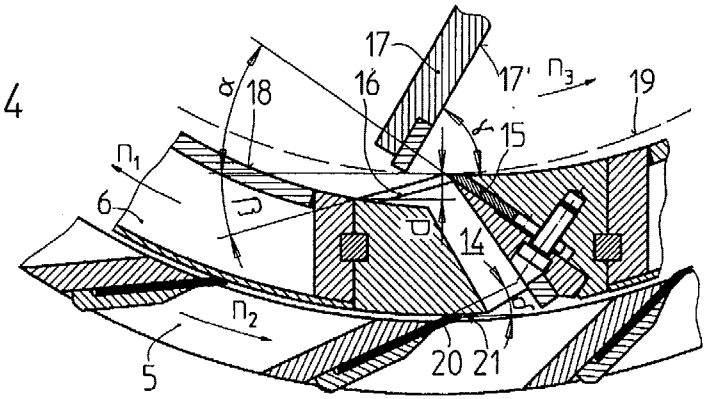
FIG. 4 a detail of FIG. 3 on a larger scale.
Figure 10:
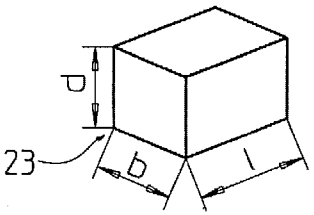
FIG. 10 a perspective view of a prismatic particle produced according to the invention.
Figure 3:
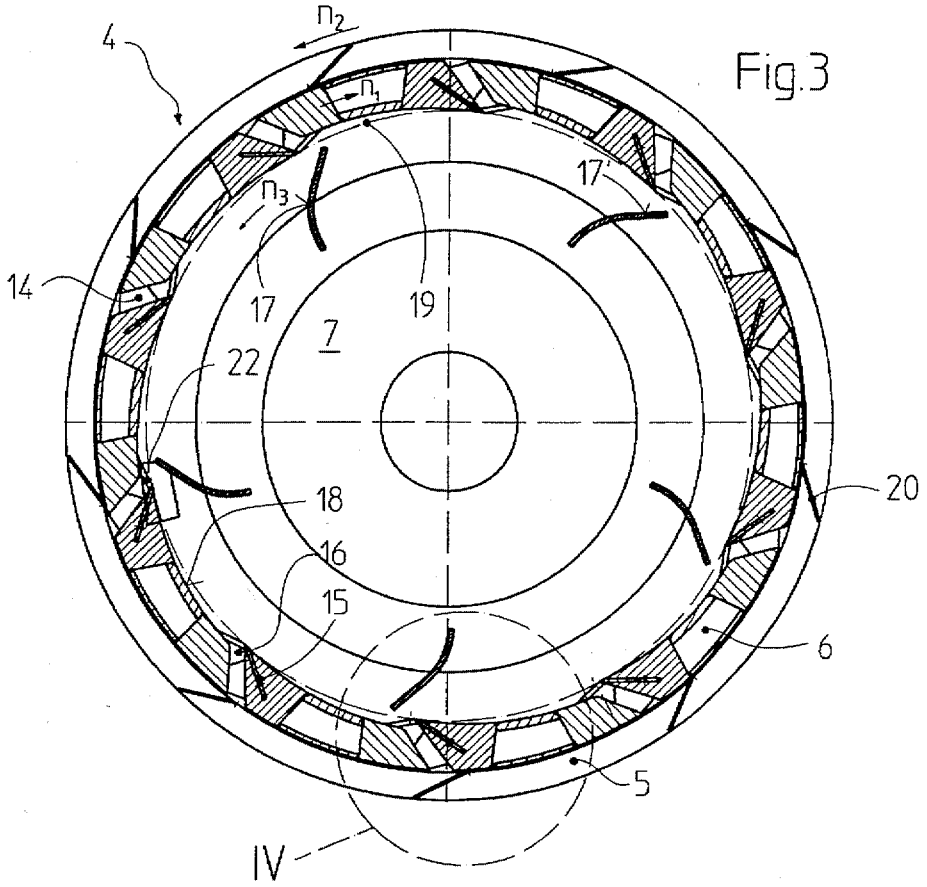
FIG. 3 a cross-sectional view taken along line III—III of FIG. 2 of the rotational cutting system according to the invention.

As shown in FIGS. 3 and 4, several passage channels 14 are arranged regularly on the periphery of the inner knife rotor 6. At the entering area of the passage channels web-like scoring blades 16, which cut the strips, and form a gate, which is immediately followed by a plate shaped knife 15, which effects the peeling cut of the slices.

When the machine is equipped with a mobile guiding system, the meat pieces 22, which have been prepared so that they can be processed by a machine, are guided toward this cutting set 15, 16 by the guiding vanes 17 of the driving rotor 7 under radial pressure generated by the centrifugal effect. The inner wall of the inner knife rotor 6 has, between the cutting sets 15, 16, peripheral sections 18. These peripheral sections 18 rise to the outside like a spiral, opposed to the rotating direction, and up to the gap d of the knife circle 19, the gap being equal to the thickness d of the slices to be peeled off from the meat pieces 22. Thereby, the meat pieces are always sliding along the spiral-shaped wall sections 18 of the inner knife rotor 6, at the same time being pressed against them. The respective gaps b between the web-like scoring blades 16 (see FIG. 5) are equal and correspond to the width b of the material strips produced by the scoring blades 16 and so also to the width b of the produced prismatic particles 23.

The outer rotor 5 is also equipped with plate shaped cross-cut knives 20 arranged evenly over its periphery, which cross-cut knives 20 cut the material slices leaving the passage channels 14 at the periphery of the inner rotor 6 into prismatic particles 23 whereby their third dimension 1 results from the cutting frequency of the outerknife rotor 5.

FIG. 4 is a detail of FIG. 3 on a larger scale illustrating details of the cutting geometry using a mobile guiding system. Thereby, the plate-shaped knives 15 cutting the slices are inclined to the tangent of the periphery under an angle of $\alpha$ whereby their cutting edges extend essentially parallel to the axis. The gradient of the cutting edges of the scoring blades 16 forming a gate and cutting the strips from the meat pieces 22 forms with the tangent of the periphery an apical angle $\beta$ rising slowly opposed to the rotating direction. The effective flanks 17' of the rotating guiding vanes 17 are inclined at an angle of $\gamma$ in relation to the tangent of the periphery.

Finally, the plate-shaped cross-cut knives 20 of the outer knife rotor 5 show at the periphery of the inner knife rotor 6 an angle of inclination $\delta$. Experience has shown that the following values are particularly suitable:

$\alpha$-between 25° and 30°; $\beta$ between 10° and 20°

$\gamma$ between 40° and 50°; $\delta$ between 20° and 30°

Figure 8:
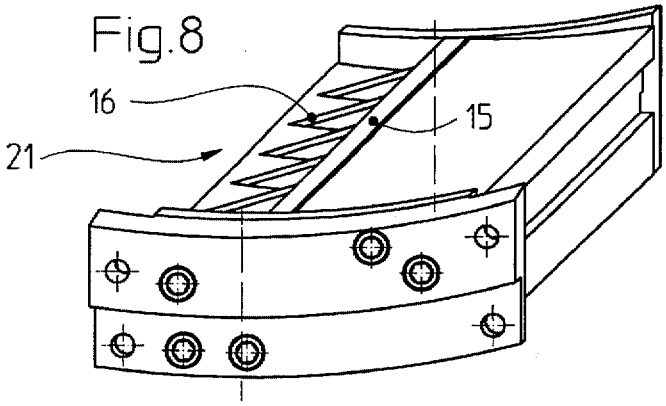
FIG. 8 the exchangeable knife cassette with the knife set for the cutting of the slices and strips.

It is further obvious from FIG. 4 that the cutting sets, cutting the slices and strips, the plate-shaped knives 15 and the gate forming scoring blades 16, being grouped together with the corresponding passage channels in an exchangeable constructional unit, can be inserted in the inner knife rotor 6 in form of the knife "cassette" 21 illustrated by FIG. 8. This allows a quick exchange of the cutting sets, which may be required due to wear or because the production parameters have changed.

Figure 6:
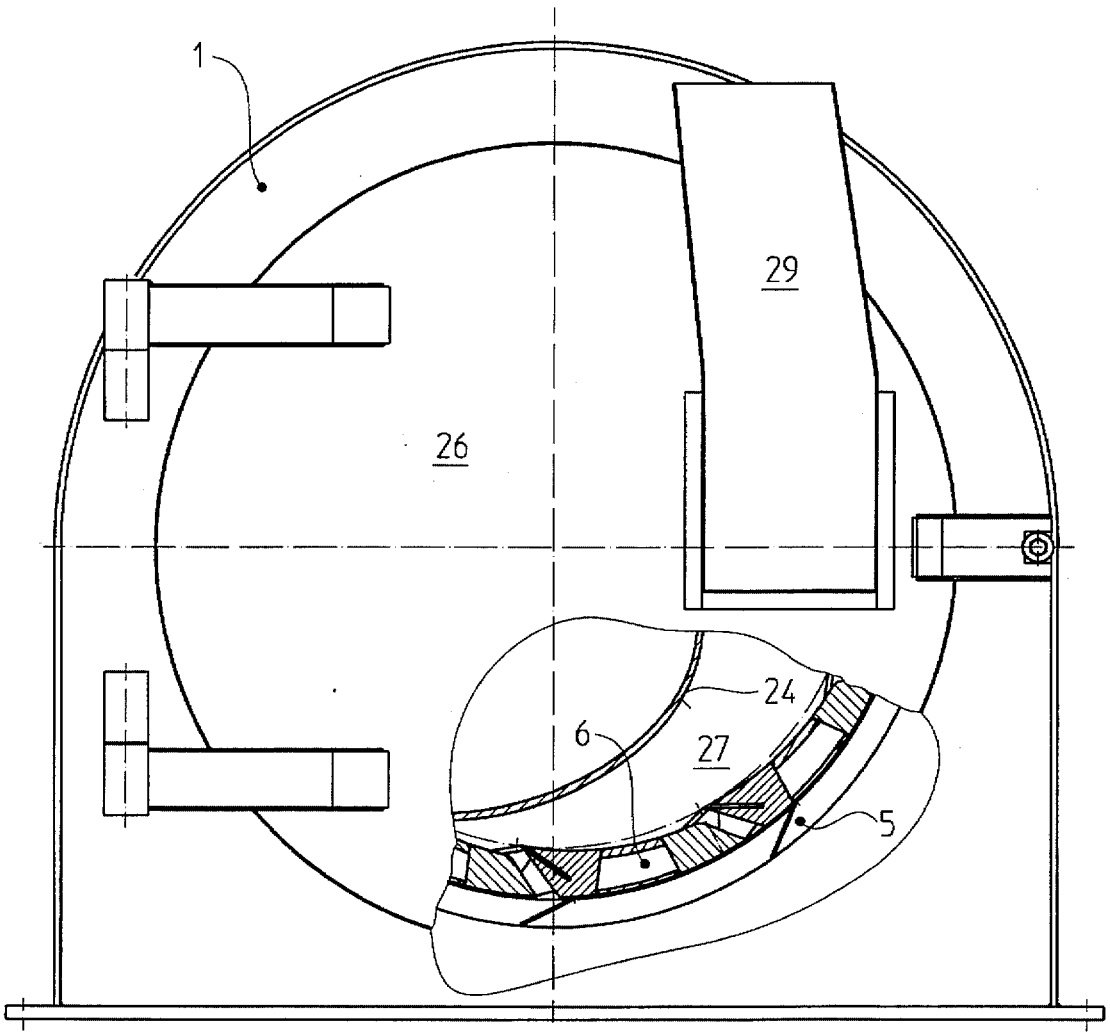
FIG. 6 a front view of the machine according to the invention with a stationary guiding system with portions broken away to illustrate the interior structure.
Figure 7:
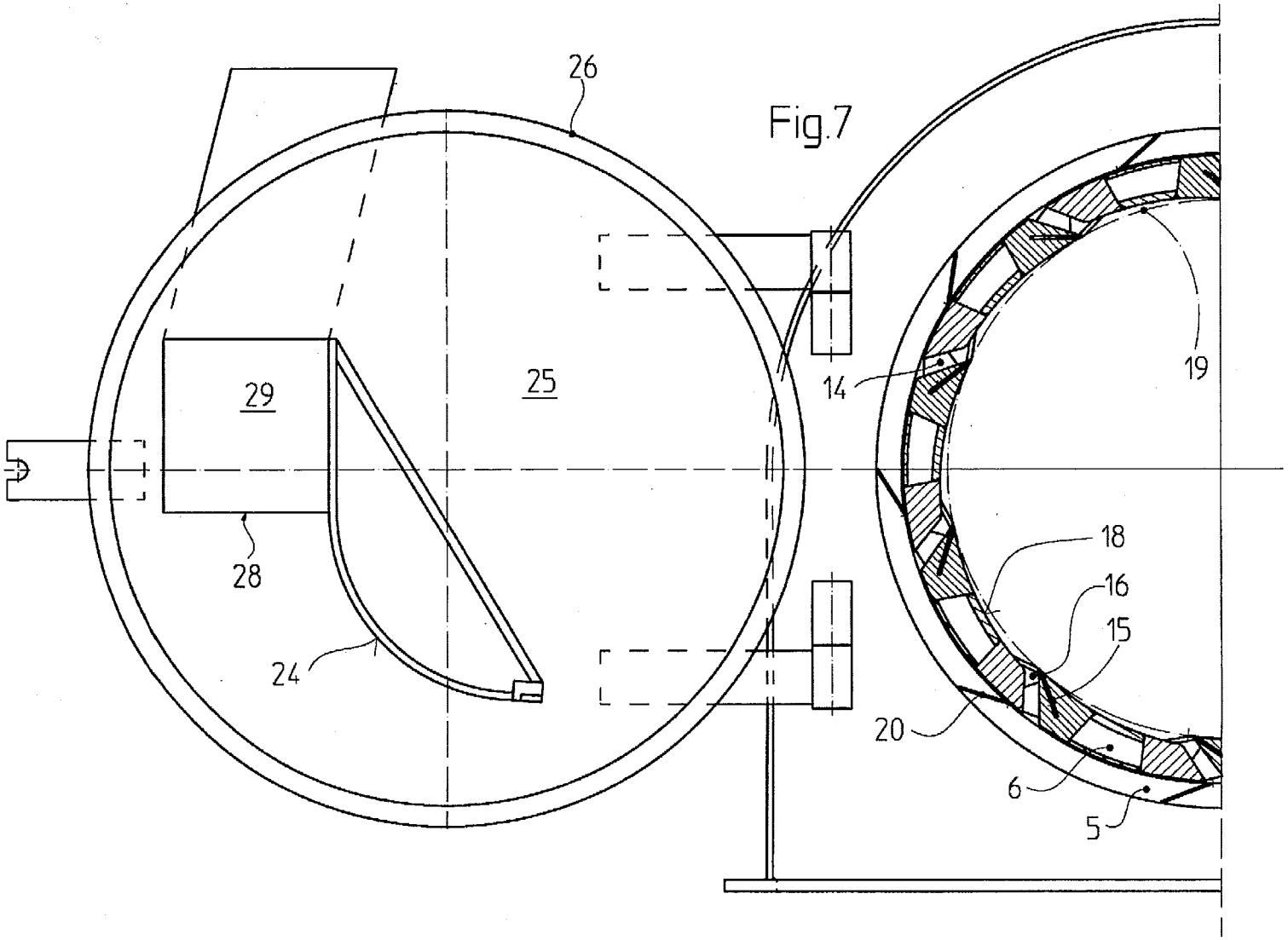
FIG. 7 the arrangement of the stationary guiding system at the inner wall of the housing door.

In the stationary guiding system illustrated in FIGS. 6 and 7 the driving rotor 7 of the mobile guiding system has been replaced by a stationary guideway 24 fastened onto the inside 25 of the housing door 26 in such a way that it can be exchanged. When the door is closed the guideway 24 juts into the interior of the inner knife rotor 6. The effective flank of the guideway is curved toward the inner knife rotor 6 in the direction of rotation whereby, as illustrated in FIGS. 6, 7 and 9, it is curved like a spiral in such a manner that it forms, together with the cylindrical inner wall of the inner rotor 6, a steadily narrowing guiding channel 27. The infeed chute 29 mounted excentrically at the housing door 26 ends into the inlet opening 28 of the guiding channel 27. From this infeed chute 29 the meat pieces 22 slide into the guiding channel 27 with an initial speed $v_0$. In the guiding channel 27 the meat pieces are grasped by the cutting tools 15, 16 of the knife rotor 6 and accelerated additionally in the direction of rotation by the cutting force $F_s$ acting as motive force. Thereby the meat pieces slide on the spiral-shaped guideway 24 whereby they are constantly pressing on the cylindrical inner wall of the inner knife rotor 6 equipped with the cutting tools 15, 16 due to the wedge effect generated in the steadily narrowing guiding channel 27. This force of pressure autogeneously generated by the knife rotor 6 makes the meat pieces 22 slide close to wall sections 18 of the knife rotor 6, the sections extending sprirally outwardly. At the end of the wall sections the meat pieces are scored by the scoring blades 16 forming the gate in a depth which corresponds to the thickness d of the slices peeled off immediately afterwards by the knives 15.

As illustrated in the FIG. 9 for the cases a, b and c, the curvatures of the guideway 24 according to the Archimedean spiral having curvature gradients e, which can be adapted to the determinant material characteristics of the material pieces, like consistence, and friction coefficient have shown to be advantageous. The quantity of the forces of pressure generated by the wedge effect in the narrowing guiding channel 27 can be estimated approximately by the following reflection: If at a point P of the spiral-shaped guideway 24 the tangent $t_{sp}$ is applied and if it is assigned to it at the same point of the tangent of the circle $t_{kr}$, so both tangents enclose the difference angle $\epsilon$ corresponding approximately to the effective wedge angle of the present material wedging in the guiding channel 27. The cutting force $F_s$ acting as motive force and applied constantly on the material pieces 22 by the cutting tools 15, 16 of the knife rotor 6 represents the resistance that the material pieces oppose to the penetration of the cutting edges due to the material displacement. So it is understandable that the higher the consistence of the material of the pieces 22 to be processed is, the higher is the resistance and consequently the cutting force $F_s$.

In the steadily narrowing guiding channel 27, this cutting force $F_s$ acting as motive force generates, due to the known wedge principle, a normal force $F_n$ beginning at the spiral-shaped guideway 24 and acting in direction of the vertical line of its tangent. This normal force presses the material pieces against the inner wall of the knife rotor 6 according to the known wedge relation: $F_n=F_s:\sin\epsilon$; so $F_n/F_s=1/\sin\epsilon=a$, whereby a is the increasing factor by which the normal forces $F_n$, with which the material pieces 22 are pressed against the knife rotor 6, are larger than the cutting forces $F_s$ which are causing them.

These ratios of forces for the three versions a, b and c of the spiral-shaped guideway 24 are illustrated in FIG. 9 and show that the less the spiral-shaped guideway 24 is curved (the smaller its curvature gradient e) is, the higher the multiplication factor a is. For materials of high consistence, which cause high cutting forces $F_s$, to which frozen meat certainly belongs, version c seems to be suitable. On the contrary, version a of the spiral is suitable for material causing low cutting forces $F_s$, such as sugar beets. The designing engineer has to determine the curvature gradient e of the spiral shaped guideway 24 most suitable for the consistence of the material to be processed so that the reaction forces acting on the guideway 24 remain within controllable margins.

A further aspect the designing engineer has to take into consideration when designing the spiral-shaped guideway 24 results from the question under which circumstances the material pieces 22 may bar the guiding channel 27 due to friction. Such a barring may happen when the friction force $F_r$ exceeds the motive force $F_s$, that means when: $F_r=\mu\times F_n\geqq F_s$, whereby $\mu$ is the respective coefficient of friction of a material piece 22 on a steel support. If $F_n=a.F_s$, then the critical, or the maximum permissible coefficient of friction for the respective material piece, is $\mu_{kr}=1/a=\sin\epsilon$. Thus, the lower the curvature gradient e of the spiral shaped guideway 24 is, the greater the likelihood of a barring due to friction. The three critical coefficients of friction indicated in FIG. 9 for the three examined forms of spirals show that a barring of frozen meat pieces on steel is not likely to happen due to their very low coefficient of friction. But when processing cuttable industrial products like caoutchouc, rubber or plastics for which the size-reduction machine according to the present invention is also usable, the indicated limit values $\mu_{kr}$ may be exceeded so that when designing the spiral-shaped guideway 24 for these materials the barring problem caused by friction must be taken into consideration.

In conclusion the following theoretical considerations based on FIG. 9 allow the following deductions: the sojourn time of a material piece in the steadily narrowing guiding channel 27 is equal to the time the knife rotor 6 needs to thoroughly reduce the piece of material. As a consequence, the sojourn time of material pieces of the same thickness in the guiding channel 27 is the same for all versions of the guiding channel. A further consequence is that the longer the guiding channel is, the faster the material pieces pass through the guiding channel. As the cutting speed results from the difference between the rotational speed of the cutting tools 15, 16 and the speed of the material pieces in the guiding channel 27, the shorter the guiding channel 27 is, which means the higher the curvature gradient e of the spiral shaped guideway 24, the higher the cutting speed will be. It is also obvious that the material throughput is higher when more material pieces are being cut at the same time by the cutting tools 15, 16 of the knife rotor 6. As a consequence, the smaller the curvature gradient e of the spiral-shaped guideway 24, the higher the material throughput will be.

It is further obvious that the stationary guiding system consisting of the spiral-shaped guideway 24 is more advantageous than the mobile guiding system consisting of the driving rotor 7. As the third rotor is not necessary, the construction is much simpler and the power consumption considerably lower. On the other hand, heavy, uncontrolled beats on the fed material pieces are avoided and consequently the amount of undesired fine particles in the produced prismatic product is also considerably reduced. And in the end, the absolutely necessary force pressing the material pieces against the inner knife rotor 6 is maintained until the pieces of material are completely reduced in size, whereby the optimum force of pressure required is automatically given according to the respective consistency of the material pieces.

I claim:

1. A size-reducing apparatus for reducing the size of cuttable pieces and forming substantially uniformly shaped products with defined edge lengths (d, b, l), comprising:

a rotational cutting system for effecting a three dimensional cut, said rotational cutting system having a first cutting tool for slicing the cuttable pieces to a thickness d and for cutting the sliced pieces lengthwise into strips having width b, and a second cutting tool for cross-cutting the strips into length l to form the substantially uniformly shaped products having the defined edge lengths d, b, l, wherein the rotational cutting system includes an inner knife rotor and an outer knife rotor concentric with the inner knife rotor, the inner knife rotor carrying the first cutting tool, which is exposed to an inner periphery thereof, for cutting the cuttable pieces into slices and strips and the outer knife rotor carrying the second cutting tool for cross-cutting the strips into the substantially uniformly shaped products; and guiding means in an interior of the inner knife rotor for guiding and forcing the cuttable pieces with pressure to allow the first cutting tool to cut the cuttable pieces into slices and strips.

2. An apparatus as claimed in claim 1, wherein the first cutting tool comprises a plurality of spaced apart plate-shape knives and a plurality of sets of spaced apart gate forming knives, each knife having a cutting edge, the plate-shaped knives being positioned in relation to tangents of a periphery of the inner knife rotor at an angle (α) and the cutting edges of the plate-shaped knives being substantially parallel to an axis of the inner knife rotor, wherein the inner knife rotor has a plurality of passage channels, each adjacent one of the plate-shaped knives, and one of the sets of the gate forming knives being positioned in each passage channel with the cutting edges thereof positioned in an inlet zone of the passage channel for cutting the cuttable pieces into strips, wherein the second cutting tool for cross-cutting the strips is positioned to pass across an outlet zone of each of the passage channels adjacent an outer periphery of the inner rotor as the inner and outer knife rotors rotate relative to each other, to cut the strips passing through the passage channels and form the substantially uniformly shaped products having the defined edge lengths.

3. An apparatus as claimed in claim 2, wherein the gate forming knives of each set are positioned parallel along the axial direction of the inner knife rotor and spaced apart by an equal axial distance (b), wherein the cutting edges thereof extend at an apical angle (β) relative to the cutting edge of the respective plate-shaped knife positioned adjacent thereto.

4. An apparatus as claimed in claim 3, wherein the inner knife rotor has a plurality of peripheral sections, each of the two adjacent peripheral sections being spaced apart and defining one of the passage channels and having each of two adjacent ends offset in a radial direction, the offset defining the slice thickness (d) of the cuttable pieces to be sliced.

5. An apparatus as claimed in claim 2, wherein the first cutting tool for cutting the cuttable pieces into slices and strips is removable as a unit from the inner knife rotor.

6. An apparatus as claimed in claim 1, wherein the guiding means for the material pieces arranged in the interior of the inner knife rotor comprises a stationary guideway inclined toward and extended in the direction of rotation of the inner knife rotor.

7. An apparatus as claimed in claim 6, wherein the stationary guideway is curved in an Archimedean spiral so forming with the inner knife rotor a guiding channel steadily narrowing in the direction of rotation of the inner knife rotor.

8. An apparatus as claimed in claim 7, further comprising a housing door, wherein the stationary guideway is removably fastened at the inside of the housing door.

9. An apparatus as claimed in claim 1, wherein the guiding means comprises guiding vanes connected to a driving rotor arranged concentrically within the inner knife rotor, the guiding vanes being inclined toward the revolving direction of the inner knife rotor at an angle (γ) relative to revolving tangents of the inner knife rotor.

10. An apparatus as claimed in claim 1, wherein the second cutting tool arranged on the outer knife rotor comprises a plurality of plate-shaped knives inclined toward the revolving tangent at an angle (γ), the cutting edge thereof being substantially parallel to the axis of the inner knife rotor.

11. An apparatus as claimed in claim 1, wherein the first cutting tool substantially simultaneously divides the cuttable pieces into a plurality of strip sections and then slices the strip sections to form individual strips.

* * * * *

UNITED STATES PATENT AND TRADEMARK OFFICE

CERTIFICATE OF CORRECTION

PATENT NO. : 5,673,863
DATED : October 07, 1997
INVENTOR(S) : Hartmut PALLMANN

Figure 9A:
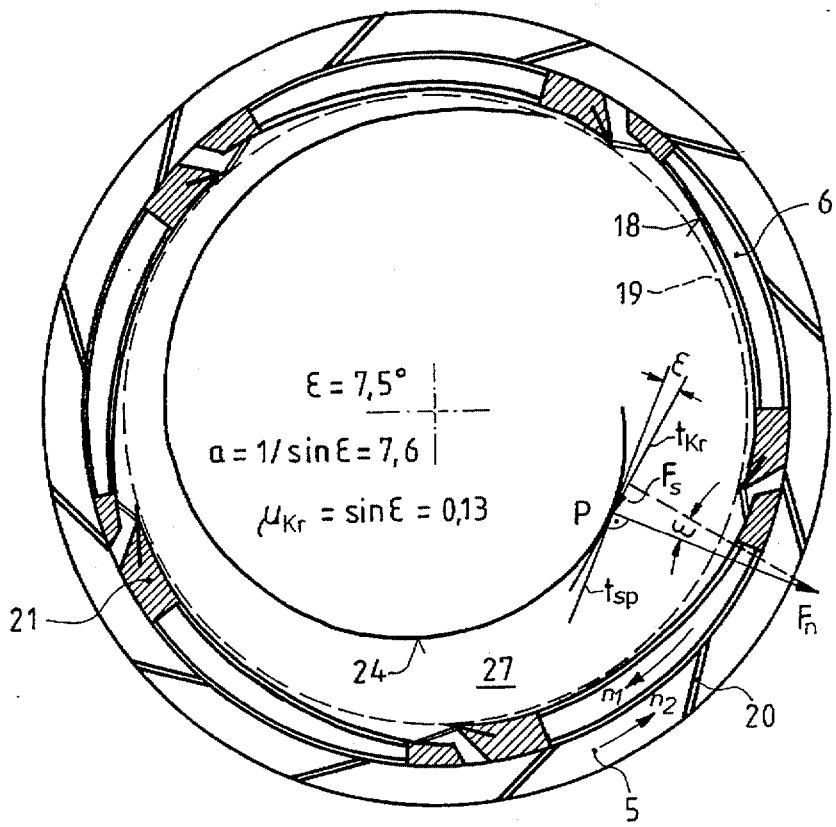
FIG. 9 three versions a, b, and c of the spiral-shaped guideway of the stationary guiding system.
Figure 9B:
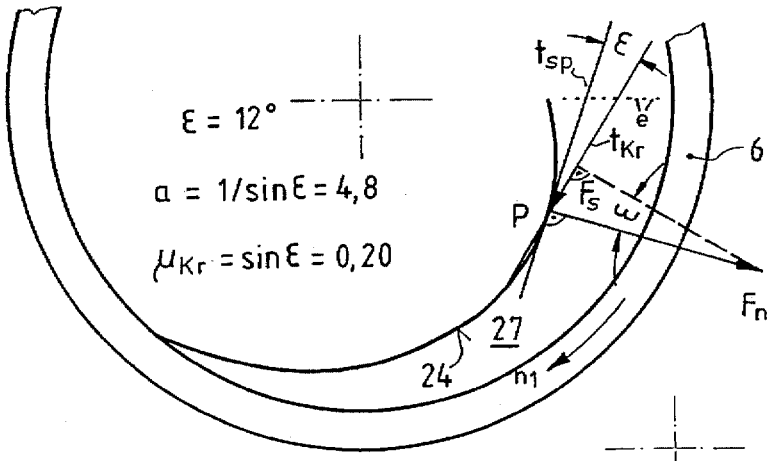
Figure 9C:
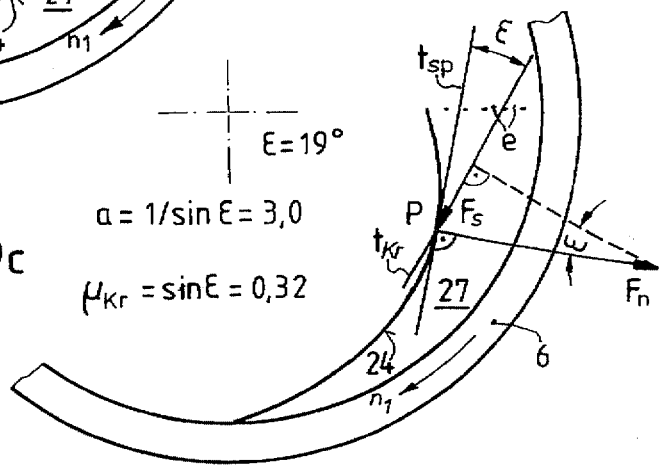

It is certified that error appears in the above-identified patent and that said Letters Patent is hereby corrected as shown below:

Column 4, line 29, delete "FIG. 9" and insert -- FIGS. 9a-c --. Column 5, line 53, delete "9" and insert -- 9a-c --. Column 6, line 8, delete "FIG. 9 for the cases a, b and c," and insert -- FIGS. 9a-c --; line 41, delete "FIG. 9", insert -- FIGS. 9a-c --; and line 66, delete "FIG. 9", insert -- FIGS. 9a-c --. Column 7, line 10, delete "FIG. 9" and insert -- FIGS. 9a-c --.

Signed and Sealed this
Thirtieth Day of June, 1998

*Attest:*

Bruce Lehman

BRUCE LEHMAN

*Attesting Officer*

*Commissioner of Patents and Trademarks*